US011335216B2

(12) United States Patent
Peng et al.

(10) Patent No.: US 11,335,216 B2
(45) Date of Patent: May 17, 2022

(54) DISPLAY PANEL, FOLDING METHOD THEREOF, AND DISPLAY DEVICE

(71) Applicant: Wuhan China Star Optoelectronics Semiconductor Display Technology Co., LTD., Hubei (CN)

(72) Inventors: Ningkun Peng, Wuhan (CN); Shaojing Wu, Wuhan (CN)

(73) Assignee: Wuhan China Star Optoelectronics Semiconductor Display Technology Co., LTD., Hubei (CN)

( * ) Notice: Subject to any disclaimer, the term of this patent is extended or adjusted under 35 U.S.C. 154(b) by 184 days.

(21) Appl. No.: 16/622,382

(22) PCT Filed: Nov. 7, 2019

(86) PCT No.: PCT/CN2019/116145
§ 371 (c)(1),
(2) Date: Dec. 13, 2019

(87) PCT Pub. No.: WO2021/035958
PCT Pub. Date: Mar. 4, 2021

(65) Prior Publication Data

US 2021/0335154 A1 Oct. 28, 2021

(30) Foreign Application Priority Data

Aug. 28, 2019 (CN) ..... 201910802483.X

(51) Int. Cl.
*G09F 9/30* (2006.01)

(52) U.S. Cl.
CPC ..... *G09F 9/301* (2013.01)

(58) Field of Classification Search
CPC ..... G09F 3/30; G09F 3/301; G06F 1/1652; G02F 1/13452; H01L 27/124; H01L 27/3176; H05K 2201/10128
See application file for complete search history.

(56) References Cited

U.S. PATENT DOCUMENTS

2013/0002572 A1* 1/2013 Jin ..... G02F 1/133305 345/173
2014/0002385 A1* 1/2014 Ka ..... H05B 33/22 345/173
2014/0355227 A1* 12/2014 Lim ..... G02F 1/13452 361/749

(Continued)

FOREIGN PATENT DOCUMENTS

CN 108155219 A 6/2018
CN 207624701 U 7/2018
CN 109166894 A 1/2019

*Primary Examiner* — Joe H Cheng
(74) *Attorney, Agent, or Firm* — Benesch, Friedlander, Coplan & Aronoff LLP

(57) ABSTRACT

A display panel, a folding method thereof, and a display device are provided. The display panel includes a display region, a non-display region, and a bending region. Side edges of the bending region include bending points, the bending points are disposed in the bending region, and the side edges are concaved toward an interior of the bending region at the bending points. During folding, the bending points on the side edges of two sides form at least one guiding axis, which makes the display panel easier to bend, and folding precision and folding effect are good.

18 Claims, 4 Drawing Sheets

(56) References Cited

U.S. PATENT DOCUMENTS

| | | | | |
|---|---|---|---|---|
| 2015/0102298 | A1* | 4/2015 | Namkung | H01L 51/0097 257/40 |
| 2017/0170206 | A1* | 6/2017 | Lee | H01L 29/78633 |
| 2017/0302772 | A1* | 10/2017 | Zhang | H05K 1/028 |
| 2017/0338294 | A1* | 11/2017 | Choi | H01L 51/5237 |
| 2018/0123060 | A1* | 5/2018 | Jang | H01L 27/1218 |
| 2019/0189640 | A1* | 6/2019 | Huang | H01L 51/0097 |
| 2019/0206968 | A1 | 7/2019 | Yang et al. | |
| 2020/0310493 | A1* | 10/2020 | Kim | G06F 1/1609 |
| 2020/0371549 | A1* | 11/2020 | Park | H01L 51/5253 |
| 2020/0380918 | A1* | 12/2020 | Cho | H01L 27/3276 |
| 2020/0381638 | A1* | 12/2020 | Kim | H01L 27/3276 |
| 2021/0013287 | A1* | 1/2021 | Bang | G06F 1/1652 |
| 2021/0013447 | A1* | 1/2021 | Lee | H04M 1/0266 |
| 2021/0066656 | A1* | 3/2021 | Kim | H01L 51/56 |
| 2021/0074795 | A1* | 3/2021 | Tomioka | H05B 33/02 |
| 2021/0082343 | A1* | 3/2021 | Lee | H01L 27/323 |
| 2021/0249616 | A1* | 8/2021 | Chung | H01L 51/56 |

* cited by examiner

DISPLAY PANEL, FOLDING METHOD THEREOF, AND DISPLAY DEVICE

CROSS REFERENCE TO RELATED APPLICATIONS

This application is the National Stage of PCT/CN2019/116145 filed on Nov. 7, 2019, which claims priority under 35 U.S.C. § 119 of Chinese Application No. 201910802483.X filed on Aug. 28, 2019, the disclosure of which is incorporated by reference.

FIELD OF INVENTION

The present disclosure relates to the field of display technologies, and in particular, to a display panel, a folding method thereof, and a display device.

BACKGROUND OF INVENTION

Compared with liquid crystal display devices, organic light-emitting devices (OLED) have advantages of self-luminous, fast response times, light weight and thinness, and the like, and have been widely used in display devices of various fields.

In various display products, especially in the field of flexible display panels, in order to pursue a narrow bezel design, it is often necessary to bend some regions of display panel so that a portion of the region is bent to the back of display panel without affecting normal use of an entire display product, thereby realizing a narrow bezel display panel. However, in the bending technology of present flexible display panels, cutting edge of a bending region is straight, and after the bending region is cut, a complete straight edge will be formed. During folding, bending amount of the left and right sides is different, which leads to insufficient folding precision and affects installation and performance of the display panel. At the same time, in the straight edge cutting technology, a large bending stress is generated during folding process, and there is also a problem of stress concentration, which will break wires disposed in the bending region, thereby affecting normal display of display panel and reducing service life of display panel.

Therefore, it is necessary to propose a solution to the problems in conventional art.

Technical Problem

In summary, in conventional bending technology of display panels, there are problems that the bending amount is different between left and right sides, which leads to insufficient folding precision; at the same time, a large bending stress is generated during folding process. Such concentrated stress destroys metal wires in display panels, which affects the normal use of panels and reduces service life of panels.

SUMMARY OF INVENTION

Technical Solution

In order to solve the above problems, the present disclosure provides a display panel, a folding method thereof, and a display device, which solve the problems in conventional display panels that a bending amount is different between left and right sides, which leads to insufficient folding precision; at the same time, a large bending stress is generated and causes a problem of stress concentration during folding process.

To solve above technical problem, technical solution provided by embodiments of the present disclosure is as follows.

According to a first aspect of the embodiments of the present disclosure, a display panel is provided, the display panel including:

a display region;

a non-display region; and a bending region connected to the display region and the non-display region;

wherein each of side edges of the bending region includes a bending point, the bending point is disposed in the bending region, and each of the side edges is concaved toward an interior of the bending region at the bending point; and wherein the side edges of the bending region include a first side edge and a second side edge, a distance between the bending point and the display region is less than a distance between the bending point and the non-display region.

According to an embodiment of the present disclosure, each of the first side edge and the second side edge includes the bending point.

According to an embodiment of the present disclosure, the bending point on the first side edge and the bending point on the second side edge are opposite to each other and symmetrical to a central axis of the bending region.

According to an embodiment of the present disclosure, each of the side edges includes a curve, and the bending point is disposed at a midpoint of the curve.

According to an embodiment of the present disclosure, a distance from the bending point to a line connected to two ends of the curve ranges from 200 μm to 3000 μm.

According to an embodiment of the present disclosure, each of the side edges includes a polyline.

According to an embodiment of the present disclosure, a distance from the bending point to a line connected to two ends of the polyline ranges from 200 μm to 3000 μm.

According to an embodiment of the present disclosure, the display panel further including a plurality of wires disposed in the bending region.

According to a second aspect of the embodiments of the present disclosure, a display panel is further provided, the display panel including:

a display region;

a non-display region; and a bending region connected to the display region and the non-display region;

wherein each of side edges of the bending region includes a bending point, the bending point is disposed in the bending region, and each of the side edges is concave toward an interior of the bending region at the bending point.

According to an embodiment of the present disclosure, the side edges of the bending region include a first side edge and a second side edge, and each of the first side edge and the second side edge includes the bending point.

According to an embodiment of the present disclosure, the bending point on the first side edge and the bending point on the second side edge are opposite to each other and symmetrical to a central axis of the bending region.

According to an embodiment of the present disclosure, each of the side edges includes a curve, and the bending point is disposed at a midpoint of the curve.

According to an embodiment of the present disclosure, a distance from the bending point to a line connected to two ends of the curve ranges from 200 μm to 3000 μm.

According to an embodiment of the present disclosure, each of the side edges includes a polyline, and a distance between the bending point and the display region is less than a distance between the bending point and the non-display region.

According to an embodiment of the present disclosure, a distance from the bending point to a line connected to two ends of the polyline ranges from 200 μm to 3000 μm.

According to an embodiment of the present disclosure, the display panel further including a plurality of wires disposed in the bending region.

According to a third aspect of the present disclosure, a display device is further provided, the display device including a display panel, the display panel including:

a display region;

a non-display region; and a bending region connected to the display region and the non-display region;

wherein each of side edges of the bending region includes a bending point, the bending point is disposed in the bending region, and each of the side edge is concaved toward an interior of the bending region at the bending point.

According to an embodiment of the present disclosure, the side edges of the bending region include a first side edge and a second side edge, and each of the first side edge and the second side edge includes the bending point.

According to an embodiment of the present disclosure, each of the side edges includes a curve, and the bending point is disposed at a midpoint of the curve.

According to an embodiment of the present disclosure, a distance from the bending point to a line connected to two ends of the curve ranges from 200 μm to 3000 μm.

Beneficial Effect

In summary, beneficial effects of the embodiments of the present disclosure are as follows.

The present disclosure provides a new display panel, a folding method thereof, and a display device. When the display panel is fabricated, at least one bending point is disposed at a side edge of the display panel, and side edges of the bending region of display panel are sheared into the bending region, such that the side edges are concaved toward the interior of the bending region at the bending point. Therefore, a recess is formed at the side edge of the bending region, thereby reducing the stress concentration problem at the edge of the bending region. Furthermore, bending is carried out along the bending point during folding, folding precision is high, and folding effect is good. After folding, internal stress of the display panel is balanced, which improves service life of the display panel.

DETAILED DESCRIPTION OF EMBODIMENTS

The following description of various embodiments is provided to illustrate specific embodiments of the present disclosure.

Figure 1A:
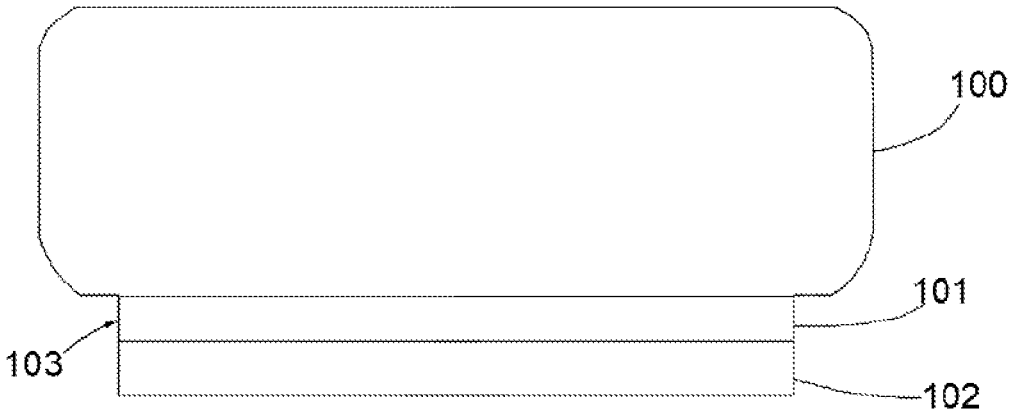
FIG. 1A is a schematic structural diagram of each layer of a display panel according to an embodiment of the present disclosure.

In the embodiment of the present disclosure, as shown in FIG. 1A, wherein FIG. 1A is a schematic structural diagram of a display panel according to an embodiment of the disclosure. The display panel includes a display region 100, a bending region 101, and a non-display region 102. The bending region 101 connects the display region 100 and the non-display region 102, and side edges 103 of the bending region 101. The other two edges of the bending region 101 are respectively connected to the display region 100 and the non-display region 102.

In order to realize a narrow bezel design of display panels, especially in flexible display panels, the bending region 101 is folded, and a portion of the display panel in the non-display region 102 is folded to a back surface of the display panel in the display region 100 and then is fixed, which effectively reduces a width of bezel of lower half of an entire display screen.

Figure 1B:
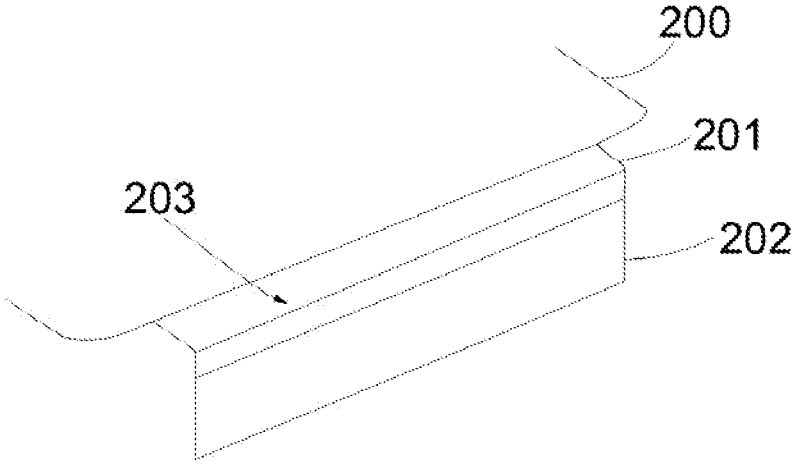
FIG. 1B is a schematic diagram of the display panel folded according to an embodiment of the present disclosure.

As shown in FIG. 1B, FIG. 1B is a schematic diagram of the display panel folded according to an embodiment of the present disclosure. Also referring to FIG. 1A, during a folding process of the display panel, the bending region 101 is bent, and the non-display region 102 is not bent.

In conventional design, both side edges 103 of the bending region 101 are straight sides, and there is no difference in every point on the side edges 103. When the folding is performed, since the side edges 103 are not guided, after the bending region 101 is subjected to a force, irregular folding and random bending occur, and an exact size of folded portion cannot be guaranteed.

Figure 2A:
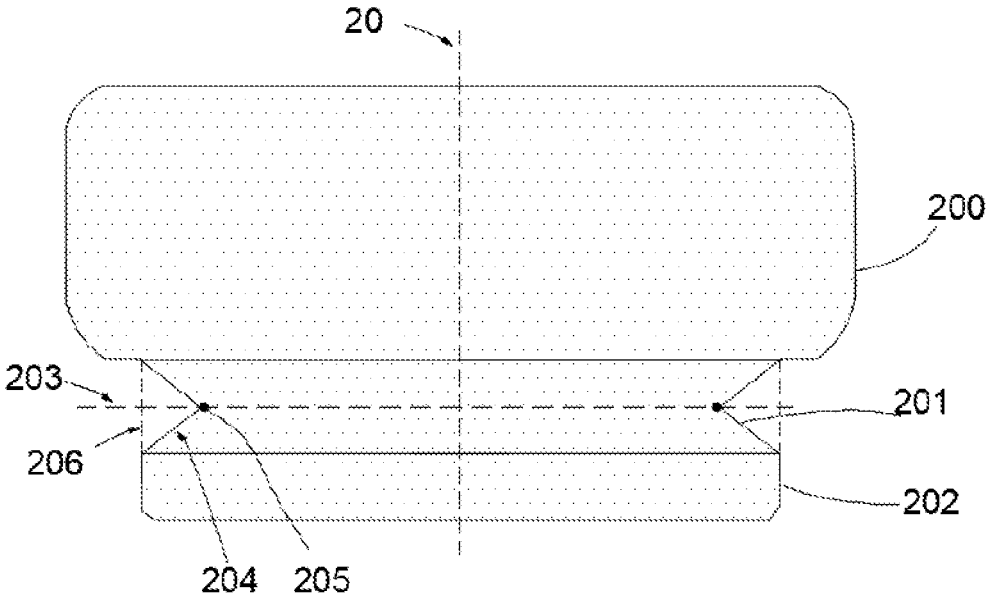
FIG. 2A is a schematic structural diagram of the display panel according to an embodiment of the present disclosure.

In the embodiment of the present disclosure, the display panel is provided, as shown in FIG. 2A, wherein FIG. 2A is a schematic structural diagram of the display panel according to an embodiment of the present disclosure. The display panel includes the display region 200, the bending region 201, and the non-display region 202. The bending region 201 connects the display region 200 and the non-display region 202.

Specifically, in the display panel provided by the present disclosure, each of two side edges 204 of the bending region 201 further includes a bending point 205. Two bending points 205 on the side edges 204 form a folding axis 203, in which the bending region 201 is bent along the folding axis 203. In this embodiment of the present disclosure, concaves are formed on both side edges 204 of the bending region 201 such that the bending points 205 on the side edges 204 are positioned in the bending region 201, and at the same time, entire side edges 204 are concaved into the bending region 201.

During folding, the side edges 204 are bent along the folding axis 203 at the bending points 205 under action of a small force, that is, the folding axis 203 acts as a folding guide, thereby, accuracy of the upper and lower two regions formed of the bending region 201 after folding is ensured.

A central axis 20 of the display panel, the bending region 201 is also symmetrical with respect to the central axis 20. Meanwhile, in order to ensure the folding effect, the two bending points 205 on the side edges 204 are symmetrical about the central axis 20.

As shown in FIG. 2A, the side edges 204 are in an angular shape from plane view, wherein a distance between the bending point 205 and the display region 200 is less than a distance between the bending point 205 and the non-display region 202. Thereby, a width of the lower bezel of the display panel after folding is better reduced; at the same time, material of the display panel is saved, and cost is reduced.

Preferably, a distance from the bending point 205 to a line connected to two ends of a polyline 206 ranges from 200 μm to 3000 μm.

Figure 2B:
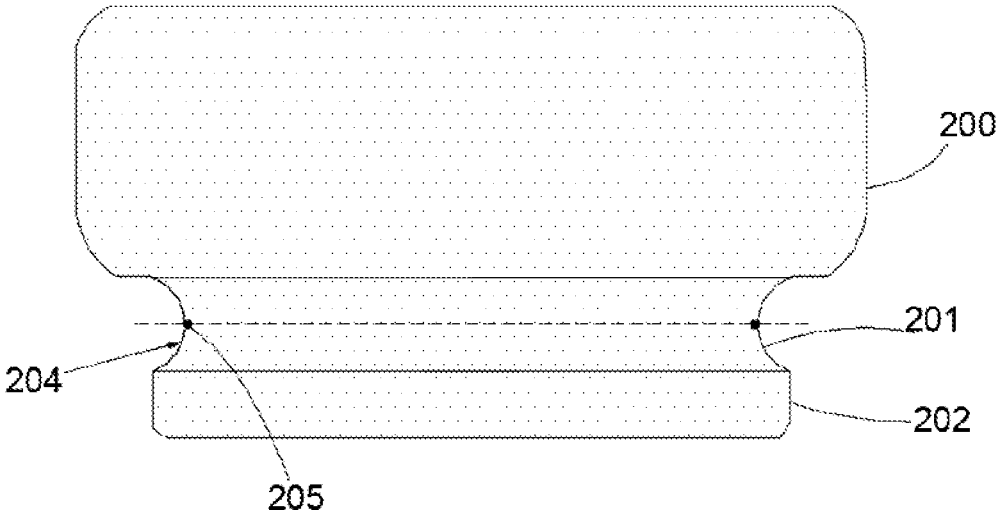
FIG. 2B is a schematic structural diagram of the display panel according to another embodiment of the present disclosure.

As shown in FIG. 2B, FIG. 2B is a schematic structural diagram of another display panel according to an embodiment of the present disclosure. Different from structure shown in FIG. 2A, in this embodiment of the present disclosure, the side edge 204 is a curve structure. The bending point 205 can be disposed at a midpoint of the curve of the side edge 204. Thus, when the bending region 201 is bent, the curve serves as a bending guide, and two portions that are bent by force are stress equilibrium, and the display panel is bent at the line connecting the two bending points 205, and the folding precision is high.

Preferably, a distance from the bending point 205 to a line connected to two ends of the curve ranges from 200 μm to 3000 μm.

Figure 2C:
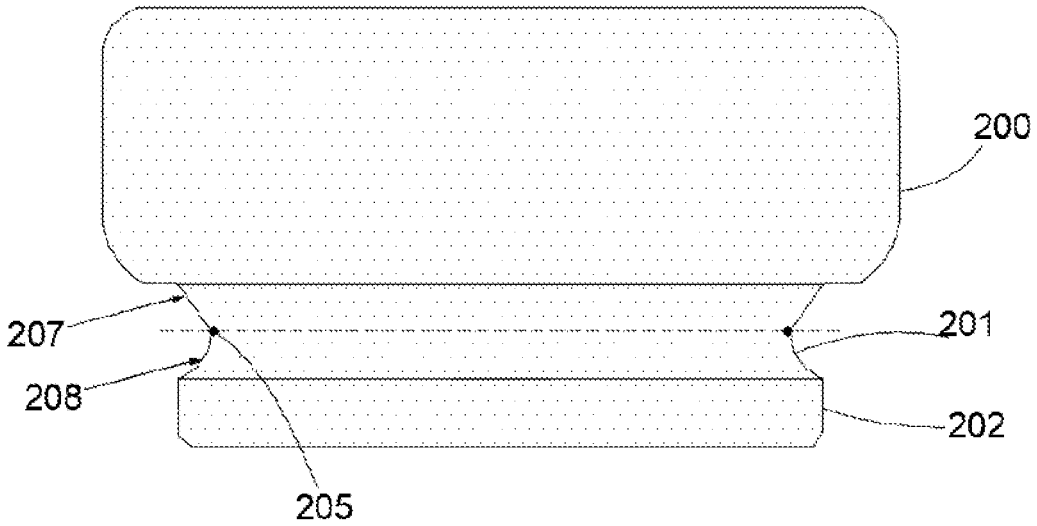
FIG. 2C is a schematic structural diagram of the display panel according to another embodiment of the present disclosure.

As shown in FIG. 2C, FIG. 2C is a schematic structural diagram of the display panel according to another embodiment of the disclosure, which is combined with FIG. 2A and FIG. 2B. In this embodiment, the side edges are formed by a straight edge 207 and a curve edge 208, and the bending point 205 is disposed at an intersection of the straight edge 207 and the curve edge 208. When the folding is performed, the bending points 205 on the both side edges form the folding axis, thereby improving folding precision of the bending region 201 and ensuring the folding effect.

Figure 2D:
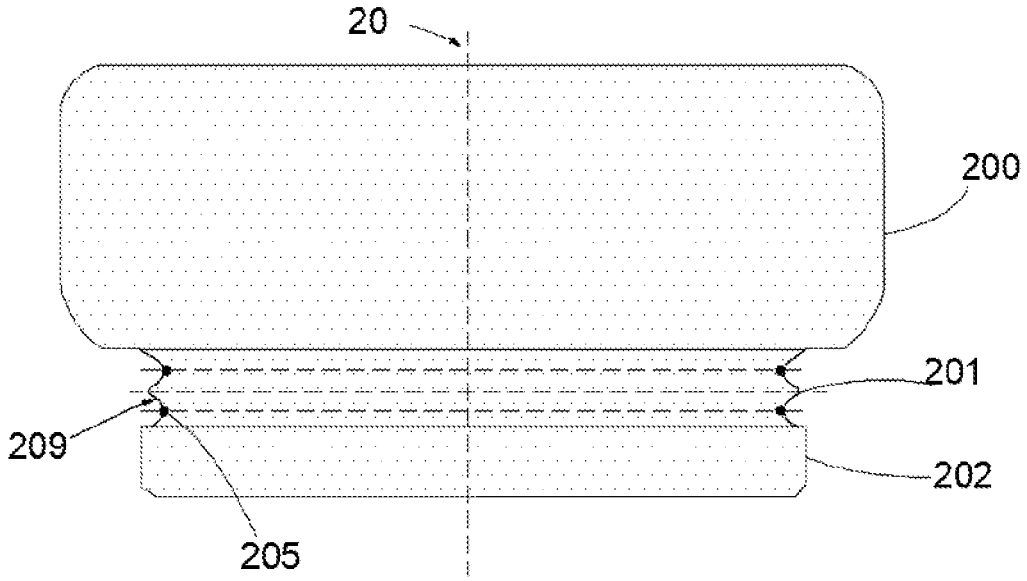
FIG. 2D is a schematic structural diagram of the display panel according to yet another embodiment of the disclosure.

As shown in FIG. 2D, FIG. 2D is a schematic structural diagram of the display panel according to yet another embodiment of the disclosure, which is combined with FIG. 2A, FIG. 2B, and FIG. 2C. In this embodiment, the recess is formed at each side edge 209, and a plurality of bending points 205 are disposed on each side edge 209, and the bending points 205 on each of the side edges 209 are symmetrically distributed along the central axis 20. The corresponding bending points 205 on both side edges form a plurality of folding axes. During folding, the bending region 201 is bent under guiding effect of the plurality of folding axes, folding efficiency is higher, also accuracy of the folding is improved.

Specifically, metal wires and a buffer layer are disposed in the bending region 201. The buffer layer can effectively protect the metal wires, and can release stress concentration generated in the bending region 201 to reduce stress distribution in the interior of the display panel. A material of the buffer layer can be selected from polyimide or other flexible material. The wires are connected to the display region 200 and the non-display region 201, and the non-display region 201 is further provided with a driving chip and a flexible circuit board to ensure normal display function of display panel. The display panel can also be a touch panel.

A second aspect of the present disclosure further provides a folding method of the display panel.

Figure 3:
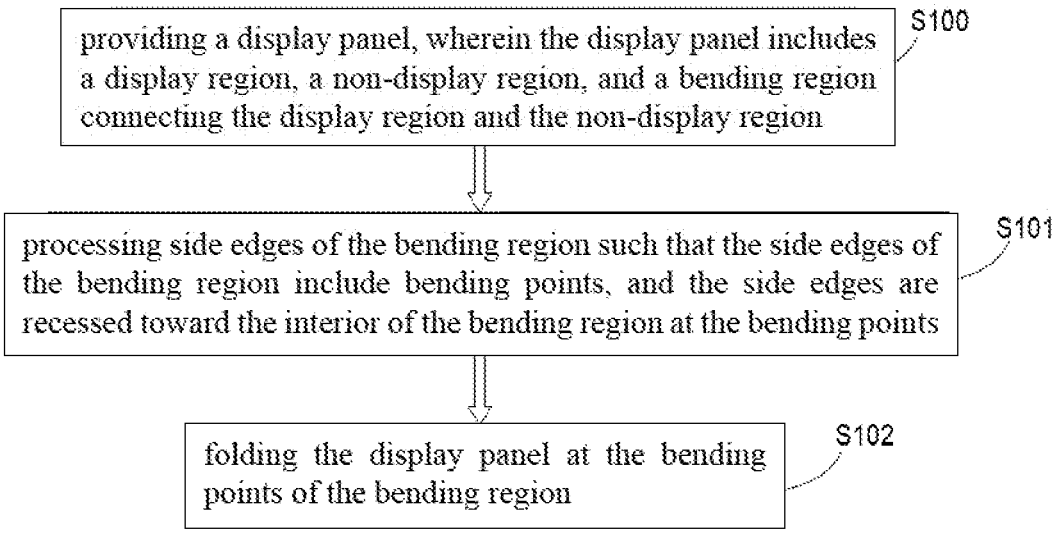
FIG. 3 is a flowchart of a folding method of the display panel according to an embodiment of the present disclosure.

Specifically, as shown in FIG. 3, FIG. 3 is a flowchart of the folding method of the display panel according to an embodiment of the present disclosure, which includes the following steps.

A step S100, providing a display panel, wherein the display panel includes a display region, a non-display region, and a bending region connecting the display region and the non-display region.

This step is mainly a bonding process of the display panel, which is beneficial to reduce the bezel of the display panel and realizes the narrow bezel of the display panel.

A step S101, processing side edges of the bending region so that the side edges of the bending region include bending points, and the side edges are concaved toward the interior of the bending region at the bending points.

Each of the side edges is sheared to form a straight edge, and material at the edge is cut away to form a recess so that the side edge is concaved toward the interior of the bending region. The cutting line can be an irregular cutting line, and a cutting direction is toward the interior of the bending region, so that the bending points on the side edges fall in the bending region, and the bending points formed by the cutting can be more than one. The corresponding bending points on the side edges of the two sides can be symmetrically distributed to each other to improve folding precision when folding.

A step S102, folding the display panel at the bending points of the bending region.

Finally, the display panel provided by the embodiments of the present disclosure is obtained.

Figure 4:
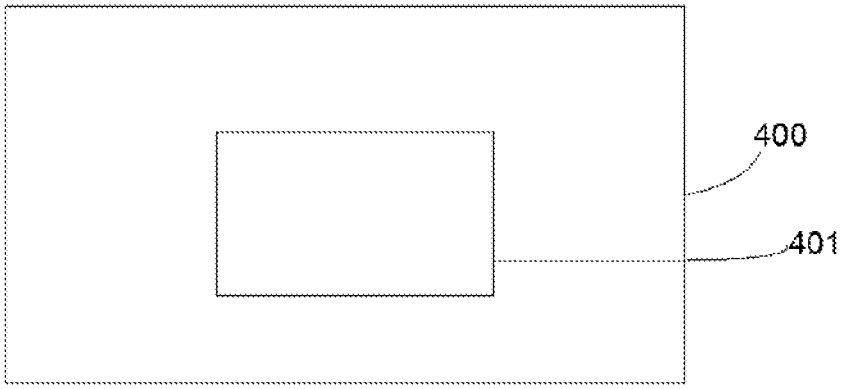
FIG. 4 is a schematic diagram of a display device according to an embodiment of the disclosure.

The present disclosure further provides a display device. As shown in FIG. 4, FIG. 4 is a schematic diagram of a display device according to an embodiment of the present disclosure. The display device 400 includes a display panel 401 provided by one of the above embodiments of the present disclosure.

The display panel, the folding method thereof, and the display device provided by the embodiments of the present disclosure are described in detail above, but not intended to impose any unduly constraint to the appended claims. For a person skilled in the art, any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A display panel, comprising:

a display region;

a non-display region;

a bending region connected to the display region and the non-display region;

a plurality of wires disposed in the bending region; and a buffer layer disposed in the bending region and configured to protect the wires;

wherein each of side edges of the bending region comprises a bending point, the bending point is disposed in the bending region, and each of the side edges is concaved toward an interior of the bending region at the bending point; and wherein the side edges of the bending region comprise a first side edge and a second side edge, and a distance between the bending point and the display region is less than a distance between the bending point and the non-display region;

wherein both sides of the bending regions are provided with recesses, and a distance between the bending point and the display region is smaller than a distance between the bending point and the non-display region.

2. The display panel of claim 1, wherein each of the first side edge and the second side edge comprises the bending point.

3. The display panel of claim 2, wherein the bending point on the first side edge and the bending point on the second side edge are opposite to each other and symmetrical to a central axis of the bending region.

4. The display panel of claim 1, wherein each of the side edges comprises a curve, and the bending point is disposed at a midpoint of the curve.

5. The display panel of claim 4, wherein a distance from the bending point to a line connected to two ends of the curve ranges from 200 μm to 3000 μm.

6. The display panel of claim 1, wherein each of the side edges comprises a polyline.

7. The display panel of claim 6, wherein a distance from the bending point to a line connected to two ends of the polyline ranges from 200 μm to 3000 μm.

8. A display panel, comprising:

a display region;

a non-display region;

a bending region connected to the display region and the non-display region;

a plurality of wires disposed in the bending region; and a buffer layer disposed in the bending region and configured to protect the wires;

wherein each of side edges of the bending region comprises a bending point, the bending point is disposed in the bending region, and each of the side edges is concaved toward an interior of the bending region at the bending point;

wherein both sides of the bending regions are provided with recesses, and a distance between the bending point and the display region is smaller than a distance between the bending point and the non-display region.

9. The display panel of claim 8, wherein the side edges of the bending region comprise a first side edge and a second side edge, and each of the first side edge and the second side edge comprises the bending point.

10. The display panel of claim 9, wherein the bending point on the first side edge and the bending point on the second side edge are opposite to each other and symmetrical to a central axis of the bending region.

11. The display panel of claim 8, wherein each of the side edges comprises a curve, and the bending point is disposed at a midpoint of the curve.

12. The display panel of claim 11, wherein a distance from the bending point to a line connected to two ends of the curve ranges from 200 μm to 3000 μm.

13. The display panel of claim 8, wherein each of the side edges comprises a polyline, and a distance between the bending point and the display region is less than a distance between the bending point and the non-display region.

14. The display panel of claim 13, wherein a distance from the bending point to a line connected to two ends of the polyline ranges from 200 μm to 3000 μm.

15. A display device comprising a display panel, the display panel comprising:

a display region;

a non-display region;

a bending region connected to the display region and the non-display region;

a plurality of wires disposed in the bending region; and a buffer layer disposed in the bending region and configured to protect the wires;

wherein each of side edges of the bending region comprises a bending point, the bending point is disposed in the bending region, and each of the side edge is concaved toward an interior of the bending region at the bending point;

wherein both sides of the bending regions are provided with recesses, and a distance between the bending point and the display region is smaller than a distance between the bending point and the non-display region.

16. The display device of claim 15, wherein the side edges of the bending region comprise a first side edge and a second side edge, and each of the first side edge and the second side edge comprises the bending point.

17. The display device of claim 15, wherein each of the side edges comprises a curve, and the bending point is disposed at a midpoint of the curve.

18. The display device of claim 17, wherein a distance from the bending point to a line connected to two ends of the curve ranges from 200 μm to 3000 μm.

* * * * *